US007806699B2

(12) United States Patent
Mark et al.

(10) Patent No.: US 7,806,699 B2
(45) Date of Patent: Oct. 5, 2010

(54) WOUND COIL COMPRESSION CONNECTOR

(75) Inventors: Gregory Mark, Cambridge, MA (US); Andrew Wallace, Cambridge, MA (US)

(73) Assignee: Methode Electornics, Inc., Chicago, IL (US)

( * ) Notice: Subject to any disclaimer, the term of this patent is extended or adjusted under 35 U.S.C. 154(b) by 0 days.

(21) Appl. No.: 12/023,976

(22) Filed: Jan. 31, 2008

(65) Prior Publication Data

US 2009/0197481 A1 Aug. 6, 2009

(51) Int. Cl.
*H01R 9/09* (2006.01)

(52) U.S. Cl. ..... 439/66

(58) Field of Classification Search ..... 439/66, 439/91, 591, 61

See application file for complete search history.

(56) References Cited

U.S. PATENT DOCUMENTS

| | | | | |
|---|---|---|---|---|
| 3,530,422 | A | 9/1970 | Goodman | |
| 3,665,370 | A | 5/1972 | Hartmann | |
| 4,227,767 | A | 10/1980 | Mouissie | |
| 4,462,657 | A | 7/1984 | Snowdon et al. | |
| 4,810,213 | A | 3/1989 | Chabot | |
| 4,927,369 | A | 5/1990 | Grabbe et al. | |
| 5,030,109 | A * | 7/1991 | Dery | 439/66 |
| 5,061,191 | A | 10/1991 | Casciotti et al. | |
| 5,088,942 | A | 2/1992 | Welsh | |
| 5,092,781 | A | 3/1992 | Casciotti et al. | |
| 5,094,636 | A | 3/1992 | Zinn | |
| 5,232,372 | A * | 8/1993 | Bradley et al. | 439/66 |
| 5,273,438 | A * | 12/1993 | Bradley et al. | 439/66 |
| 5,297,968 | A | 3/1994 | Johnson et al. | |
| 5,634,801 | A | 6/1997 | Johnson | |
| 5,667,413 | A | 9/1997 | Trafton | |
| 5,730,628 | A | 3/1998 | Hawkins | |
| 5,913,687 | A | 6/1999 | Rathburn | |
| 6,062,919 | A | 5/2000 | Trafton | |
| 6,102,746 | A | 8/2000 | Nania et al. | |
| 6,206,713 | B1 | 3/2001 | Baertsoen | |
| 6,250,974 | B1 | 6/2001 | Kerek | |
| 6,264,508 | B1 | 7/2001 | Lehmann | |
| 6,313,523 | B1 * | 11/2001 | Morris et al. | 257/696 |

(Continued)

FOREIGN PATENT DOCUMENTS

FR 465535 A 4/1914

(Continued)

OTHER PUBLICATIONS

Search Report from International Patent Application No. PCT/US2009/032033 (2009).

(Continued)

*Primary Examiner*—Gary F. Paumen
(74) *Attorney, Agent, or Firm*—Barnes & Thornburg LLP

(57) ABSTRACT

A multi-contact electrical connector and method of making are provided. An embodiment of a multi-contact electrical connector includes multiple small-scale densely packed contacts in the form conductive coils with wire loops whose elastic deformation provides a normal contact force for each contact in the connectors. The connector also includes a body that is configured to position the conductive coils. In some embodiments, the body may be elongate and the wire loop may be wrapped around the elongate body. In other embodiments, the body may have channels that extend through the body in which the conductive coils are disposed.

22 Claims, 11 Drawing Sheets

U.S. PATENT DOCUMENTS

| | | | | |
|---|---|---|---|---|
| 6,439,894 | B1 * | 8/2002 | Li | 439/66 |
| 6,447,317 | B1 | 9/2002 | Billman | |
| 6,471,555 | B2 | 10/2002 | Creze | |
| 6,659,778 | B2 * | 12/2003 | Li | 439/66 |
| 6,666,690 | B2 * | 12/2003 | Ishizuka et al. | 439/66 |
| 6,695,633 | B2 | 2/2004 | Longueville et al. | |
| 6,805,594 | B2 | 10/2004 | LaCoy | |
| 6,942,496 | B2 | 9/2005 | Sweetland et al. | |
| 6,945,790 | B2 | 9/2005 | Sweetland | |
| 6,951,465 | B2 | 10/2005 | Sweetland | |
| 6,958,616 | B1 | 10/2005 | Mahoney | |
| 6,971,927 | B2 | 12/2005 | Anbo et al. | |
| 7,223,111 | B2 | 3/2006 | Sweetland | |
| 7,021,957 | B2 | 4/2006 | Sweetland et al. | |
| 7,056,139 | B2 | 6/2006 | Sweetland | |
| 7,070,419 | B2 | 7/2006 | Brown et al. | |
| 7,077,573 | B2 | 7/2006 | Suh et al. | |
| 7,077,662 | B2 | 7/2006 | Sweetland et al. | |
| 7,083,427 | B2 | 8/2006 | Sweetland et al. | |
| 7,094,064 | B2 | 8/2006 | Sweetland et al. | |
| 7,097,495 | B2 | 8/2006 | Sweetland | |
| 7,101,194 | B2 | 9/2006 | Sweetland et al. | |
| 7,125,281 | B2 | 10/2006 | Sweetland | |
| 7,140,916 | B2 | 11/2006 | Sweetland | |
| 7,458,827 | B2 | 1/2007 | Sweetland | |
| 7,214,106 | B2 | 5/2007 | Sweetland | |
| 7,311,566 | B2 | 12/2007 | Dent | |
| 7,547,215 | B1 | 6/2009 | Mark | |
| 2003/0003784 | A1 | 1/2003 | Neidich | |
| 2003/0174949 | A1 | 9/2003 | Bhardwaj et al. | |
| 2004/0002234 | A1 * | 1/2004 | Masao et al. | 439/66 |
| 2004/0214454 | A1 | 10/2004 | Sweetland et al. | |
| 2006/0134943 | A1 | 6/2006 | Sweetland et al. | |
| 2008/0293307 | A1 | 11/2008 | Wallace et al. | |
| 2008/0293308 | A1 | 11/2008 | Mark | |
| 2009/0197476 | A1 | 8/2009 | Wallace | |
| 2009/0197481 | A1 | 8/2009 | Mark et al. | |
| 2009/0197482 | A1 | 8/2009 | Mark et al. | |

FOREIGN PATENT DOCUMENTS

| | | | |
|---|---|---|---|
| JP | 10012777 | | 1/1998 |
| WO | 2004/036697 | A1 | 4/2004 |
| WO | 2005/001998 | A2 | 1/2005 |
| WO | 2008/153764 | A2 | 12/2008 |

OTHER PUBLICATIONS

International Search Report and Written Opinion from International Patent Application No. PCT/US2009/032036 (2009).
International Search Report and Written Opinion for International Patent Application No. PCT/US2009/031970 (2009).

* cited by examiner

WOUND COIL COMPRESSION CONNECTOR

BACKGROUND

1. Field

The invention relates to electrical connectors.

2. Discussion of Related Art

Electrical connectors are used to provide a separable path for electric current to flow between components of an electrical system. In many applications, numerous connections between components can, in turn, require numerous signal and/or power connections within a given electrical connector. Lately, there has been an increase in the number of connections required for typical electronic components, and an increase in demand for greater numbers of electrical connections in electrical connectors. There has also been a general reduction in the size of electronic components, which has created demand for smaller electrical connectors. For either of these reasons, there is a need for electrical connectors with increased current density, where "current density" refers to the amount of current passed through a given connector divided by the area of the connector, along with a higher density (area density or line density) of smaller contacts. Some of these electrical connectors are required to handle as much as 5 to 20 amps per connection within the connector. Existing technologies cannot meet these requirements while also providing reliable electrical connections.

Applicants also appreciate that in many applications, particularly those involving small conductors, it can be desirable to maximize the contact area between a conductor and a mating element. Connectors with conductors that make contact over a larger area or that produce multiple contact points per connection can often support greater amounts of current flowing through the connector, and in doing so can provide connectors that can support an increased current density.

Greater contact forces can provide for a more reliable electrical connection by preventing separation of the conductor and mating element. Additionally, higher normal contact forces can cause wiping action between the conductor and the mating element when they are engaged in a sliding manner. This wiping action can help remove debris that might be on the conductor or mating element, which might otherwise reduce the reliability of the connection. Wiping action can also help break oxide layers that can limit conductivity.

Many materials and design problems are exacerbated at small size scales. Connectors with many small electrical contacts are generally more susceptible to damage during handling due to the fragility of the small contacts. Some known small-scale connectors that incorporate solder balls may experience increased failure due to solder ball cracking. Additionally, some known connectors that employ small-scale "arm" contacts protruding from a body of the connector may be easily damaged during handling. Materials and designs of electrical connectors with a high density of small contacts must maximize conductivity while maintaining sufficient contact forces, maintaining sufficient resistance to stress relaxation and creep, and maintaining sufficient durability for handling purposes.

SUMMARY

Applicants appreciate that there is a need for a connector with multiple small closely-spaced contacts with high conductivity that can maintain a required contact force over time. The conductor with multiple small closely-spaced contacts should also be sufficiently robust and durable for handling.

Accordingly, a multi-contact electrical connectors is disclosed, in accordance with an embodiment of the invention. The connector includes a plurality of conductive coils that each comprises one or more loops of conductive wire with each loop having a first bight. The connector also includes a body that positions the plurality of conductive coils. The loops are adapted and positioned to elastically deform due to physical contact between the first bight of each loop and a first mating element providing an elastic normal contact force for each contact, when the first mating element is engaged with the connector. The loops may each have a second bight adapted to elastically deform due to physical contact with a second mating element providing a normal force.

In one embodiment, the loops are sized and dimensioned to elastically deform when a separation between the first mating element and the second mating element is between about 3.6 mm and about 5.2 mm. The loops may be adapted, sized and dimensioned to produce a contact normal force of at least about 1.5 grams per contact when the first mating element and the second mating element are engaged with the connector. In one embodiment each conductive coil has four wire loops.

In some embodiments, the body extends along a longitudinal axis and has a plurality of bays. Each conductive coil includes one or more loops of conductive wire encircling the longitudinal body axis at a bay. In one embodiment, the body has 30 bays.

In some embodiments, each loop may extend along a longitudinal loop axis that is substantially perpendicular to the longitudinal body axis. Each loop may be substantially oval shaped. A diameter of the wire of the loops may be between about 0.05 mm and about 0.08 mm; however, the invention is not limited in this regard.

In some embodiments, the body of the connector has a first side, a second side, and a plurality of channels extending from the first side of the body to the second side of the body. Each coil is disposed in a channel and each channel is configured to position the coil disposed in the channel. The connector may also include a retaining element adapted and configured to prevent the conductive coils from completely exiting the channels and a retaining element channel or slot for inserting the retaining element into the body.

Another embodiment of a multi-contact electrical connector for connecting a first mating element and a second mating element includes a housing having a receptacle, a first opening and a second opening. The connector also includes at least one connector element disposed in the receptacle of the housing. Each connector element includes a plurality of conductive coils, each formed of one or more wire loops with each loop having a first bight and a second bight. The housing and the body of each connector element are adapted and configured to position the loops with the first bight of each loop of each coil extending through the first opening of the housing to contact a first mating element, and with the second bight of each loop extending through the second opening of the housing to contact a second mating element. The loops of the conductive coils are adapted and positioned to elastically deform due to contact between the first bight of each loop and the first mating element and contact between the second bight of each loop and the second mating element, providing a contact normal force for each contact when the connector is engaged with the first mating element and in contact with the second mating element. The connector may include a plurality of connector elements and may further include at least one insulating separator disposed in the receptacle of the housing between connector elements.

Yet another embodiment is a method of manufacturing a multi-contact electrical connector. The method includes providing a conductive wire and providing a body having a plurality of positioning regions. The method also includes positioning one or more loops of the conductive wire at each region forming a coil at each region. In one embodiment a positioning region is a bay on the body of the connector. In another embodiment a positioning region is a channel in the body of the connector.

In one embodiment, positioning one or more loops of the conductive wire at each region includes wrapping the conductive wire around the body at each region forming a coil positioned at each region. The method may also include positioning a spacer element along a side of the body. The conductive wire wrapped around the body at each region may encircle both the body and the spacer element. The method may also include removing the spacer element.

In another embodiment, the method includes forming each coil having one or more loops of conductive wire before positioning the one or more loops of the conductive wire at each region of the body. The body may have a first side and a second side and each region may include a channel extending from the first side of the body to the second side of the body with each channel adapted to position a coil. The body may also have one or more retaining element channels intersecting the plurality of channels of the body. Positioning the one or more loops of the conductive wire at each positioning region may include placing each coil in a channel of the body through the first side of the body, and inserting a retaining element into each retaining element channel of the body such that the retaining element is encircled by each coil disposed in each channel thorough which the retaining element extends.

In another embodiment, the body includes one or more slots formed in a first side of the body, each slot intersecting one or more channels. Positioning the one or more loops of the conductive wire at each positioning region may include providing one or more retaining elements and positioning each coil on a retaining element of the one or more retaining elements such that a spacing of the coils on the retaining element corresponds to a spacing of the channels with respect to the slot that intersects the channels. The positioning may also include inserting the one or more retaining elements with the coils into the body through the one or more slots.

Various embodiments of the present invention(s) provide certain advantages. Not all embodiments of the invention(s) share the same advantages and those that do may not share them under all circumstances. Further features and advantages of the present invention(s), as well as the structure of various embodiments of the present invention(s) are described in detail below with reference to the accompanying drawings.

BRIEF DESCRIPTION OF DRAWINGS

The accompanying drawings are not intended to be drawn to scale. In the drawings, similar features are represented by like reference numerals. For clarity, not every component is labeled in every drawing. In the drawings.

DETAILED DESCRIPTION

Figure 1C:
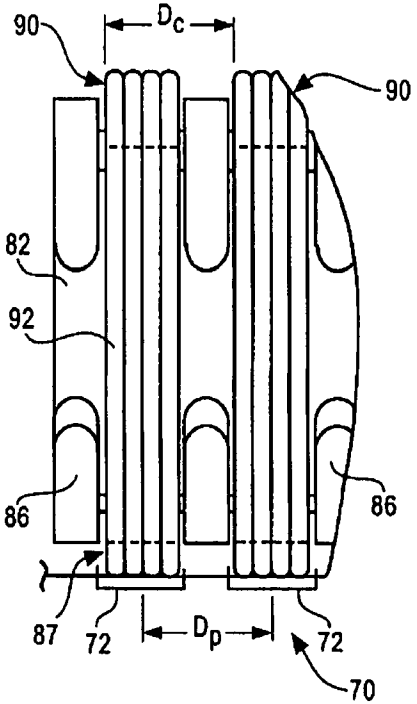
FIG. 1C depicts a front view of a detail of the connector shown in FIG. 1A with a mating element, in accordance with an embodiment of the invention.

Embodiments of the present invention provide multi-contact electrical connectors and multi-contact multi-element electrical connectors that employ multiple small-scale densely packed contacts in the form of loops of coiled wire whose elastic deformation provides a normal contact force for each contact of the connector. Exemplary multi-contact electrical connectors may have a higher contact density than comparable known conductors, and have higher mechanical reliability and greater handling durability than comparable known connectors, according to aspects of the invention.

An embodiment of a multi-contact electrical connector has a plurality of conductive coils that each includes one or more loops of conductive wire, each having a first bight. The connector also includes a body adapted to position the plurality of conductive coils. The loop are adapted and positioned to elastically deform due to contact between a mating element and the first bight of each loop providing an elastic normal contact force for each loop when the mating element is engaged with the connector.

In some embodiments, a center to center spacing of the contacts in a conductive coil may be about equal to a diameter of the wire, thus, the use of very small diameter wire for the loops provides a higher contact density. For some embodiments, constraints that are imposed on the deformation of each wire loop by neighboring loops and by the structure of the body may only allow each loop to deform substantially in a plane. Such constraints on the deformation of a loop may result in more predictable elastic contact forces that are less affected by thermal cycling than known connector designs. Additionally, small scale conductive contacts formed of wrapped wire may be both more durable and less expensive to produce than conductive contacts formed by other methods.

In some embodiments, the insulating body extends along a longitudinal axis and has a plurality of protrusions that define bays. Each conductive coil is disposed in a bay. The conductive coil at a bay may be electrically insulated from conductive coils at adjacent bays. Each conductive coil may be formed of one or more loops of conductive wire that encircles the longitudinal axis of the insulating body.

In another illustrative embodiment, a multi-contact electrical connector including a housing and at least one connector element is disclosed. The housing has a receptacle with a first opening and a second opening. The at least one connector element is disposed in the receptacle of the housing and has a body and a plurality of conductive coils each having at least one loop and each loop having a first bight and a second bight. The housing and the body of each connector element are adapted and configured to position the loops with the first bight of each loop of each coil extending through the first opening of the housing to contact a first mating element, and with the second bight of each loop extending through the second opening of the housing to contact a second mating element. The connector may include a plurality of connector elements and may further include at least one insulating separator disposed in the receptacle of the housing between connector elements.

Another embodiment is a multi-contact electrical connector with a body having a first side, a second side, and a plurality of channels extending from the first side of the body to the second side of the body. Each channel is configured to position at least one of the plurality of conductive coils. The connector may also include a retaining element adapted and configured to prevent the conductive coils from completely exiting the channels.

Another illustrative embodiment of the present invention is a method of making multi-contact electrical connectors. The method includes positioning a spacer element with a longitudinal spacer element axis along an edge of a body such that the longitudinal spacer element axis is substantially parallel to a longitudinal axis of the body. The method also includes wrapping a conductive wire around the body and the longitudinal spacer element to form one or more loops of wire encircling the longitudinal body axis, and removing the longitudinal spacer element.

Figure 1A:
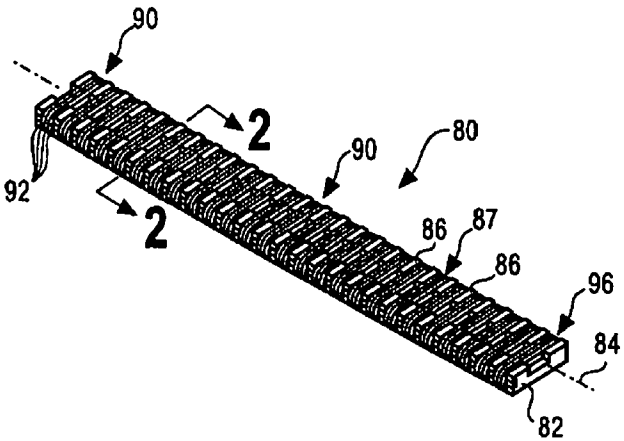
FIG. 1A depicts a perspective view of a multi-contact electrical connector, in accordance with an embodiment of the invention.
Figure 1B:
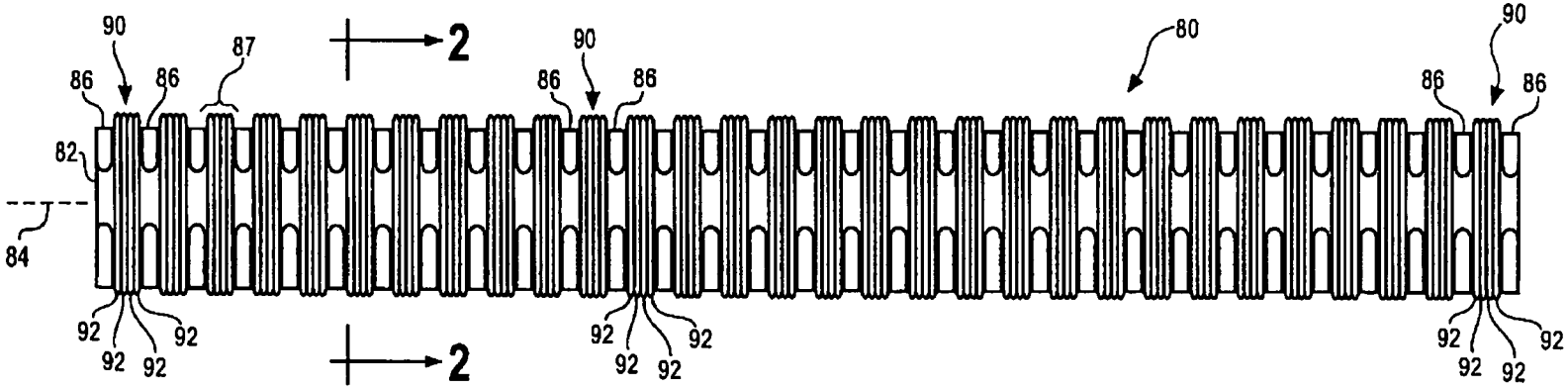
FIG. 1B depicts a side view of the connector shown in FIG. 1A.

Turning now to the figures, in FIGS. 1A and 1B, a perspective view and a side view, respectively, of a multi-contact electrical connector 80 are shown, in accordance with an embodiment of the invention. The depicted connector 80 includes a body 82. The body 82 may be electrically insulating and may be formed of an insulting material and/or an insulating coating covering some surfaces of the body 82. Alternatively, the body may be conductive, and/or the body may have conductive portions and insulative portions, as the invention is not limited in this regard.

In some embodiments the body 82 may be elongate, as depicted; however in other embodiments the body may not be elongate. Connector 80 has a body 82 that extends along a longitudinal axis 84 and has a plurality of protrusions 86 that define a plurality of bays 87; however, other embodiments may have no protrusions 86 that define bays, as the invention is not limited in this regard.

The electrical connector 80 also includes a plurality of conductive coils 90 formed of one or more wire loops 92. Each wire loop may have an arcuate shape, a polygonal shape or an irregular shape. In some embodiments, some wire loops 92 may have a different shape than other wire loops 92 in the plurality of wire loops 92, and in other embodiments all loops 92 may have a same shape. In one embodiment, each wire loop 92 encircles the longitudinal body axis 84 and has an arcuate shape, as depicted. Each conductive coil may be formed of the same number of wire loops 92 or different conductive coils 90 may be formed of different numbers of wire loops 92. Each conductive coil 90 may be formed of four wire loops 92, as shown; however, in other embodiments each conductive coil 90 may be formed of a larger number of wire loops 92, fewer wire loops 92, or each conductive coil 90 may be formed of a different number of wire loops 92. Further details regarding the wire loops 92 of the conductive coils 90 are illustrated in FIGS. 2A to 2C and discussed below.

FIG. 1C depicts a front view of a detail of the connector 80 shown in FIG. 1A in contact with a mating element 70, in accordance with an embodiment of the invention. The mating element 70 may be planar with conductive pads 72 having a pad pitch $D_p$. In this embodiment, a coil distance $D_c$, which is defined herein as a distance between a point on a first coil and a corresponding point on an adjacent coil, is chosen to be about equal to the pad pitch so that each coil 90 of the connector 80 contacts one pad 72 of the mating element. However, in other embodiments a ratio of coils to conductors may be different as the invention is not limited in this regard. In one embodiment, the pad pitch $D_p$ is approximately 0.050 inches.

Figure 2C:
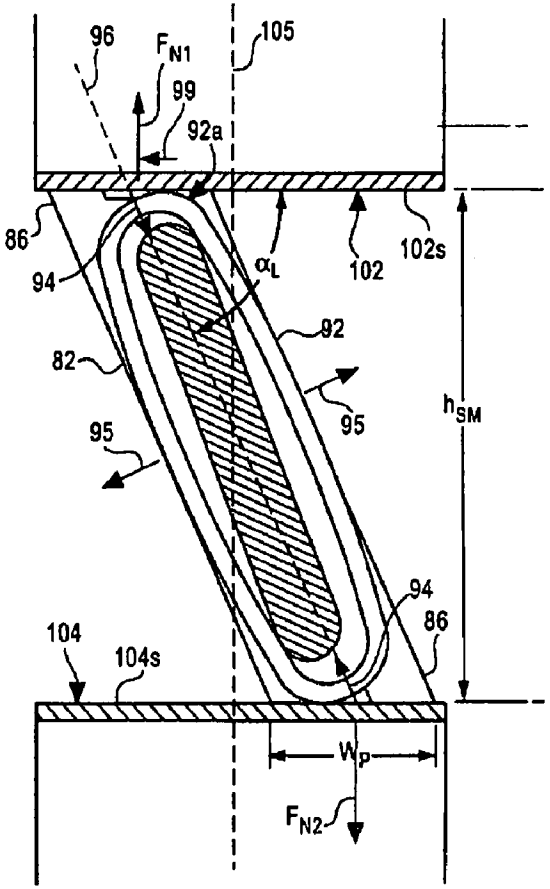
FIG. 2C schematically depicts a cross-sectional view of the connector when the first mating element and the second mating element are at a minimum separation distance.
Figure 2B:
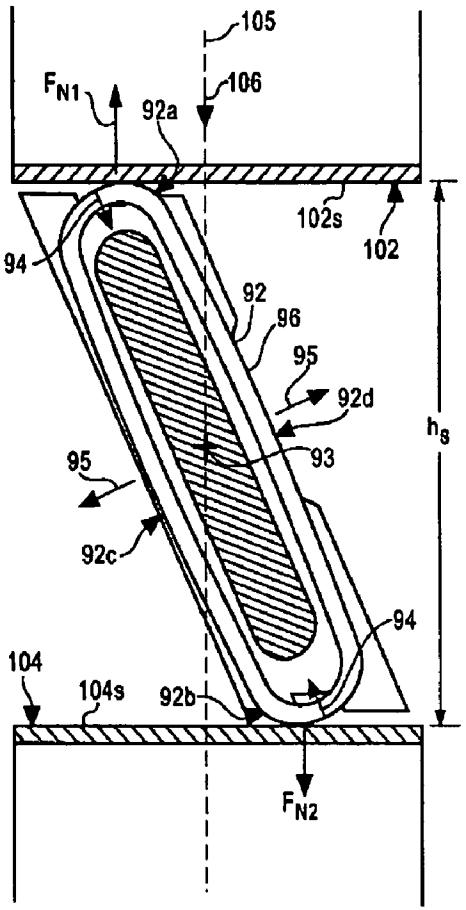
FIG. 2B schematically depicts a cross-sectional view of the connector as the connector engages the first mating element and the second mating element resulting in elastic contact normal forces.
Figure 2A:
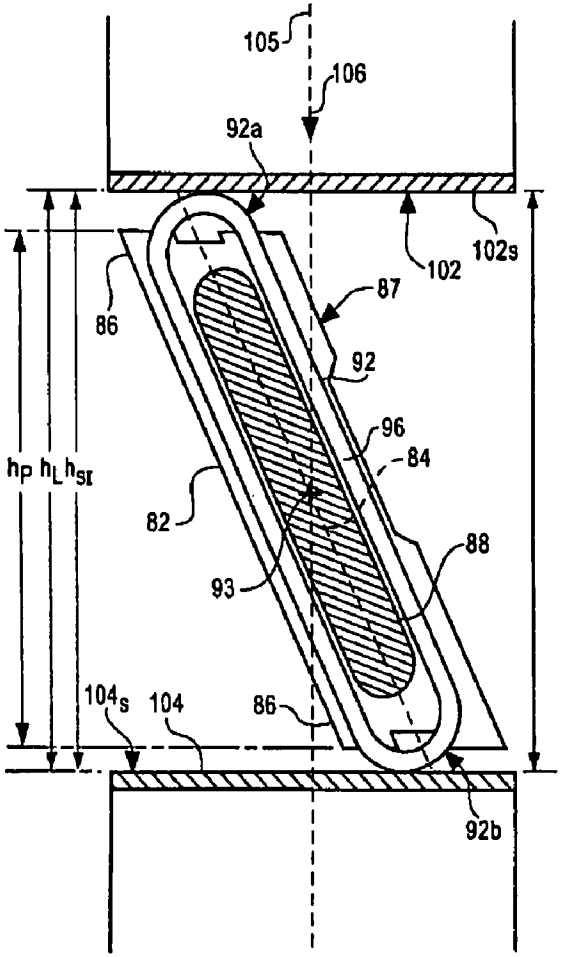
FIG. 2A schematically depicts a cross-sectional view of the connector shown in FIGS. 1A and 1B taken along line 2-2 (see also FIG. 1B) as the connector initially contacts a first mating element and a second mating element.

FIGS. 2A to 2C, which depict a cross-section of the connector 80 along the line 2-2 of FIGS. 1A and 1B, further illustrate details regarding the wire loops 92 of the conductive coils 90. As described above, in some embodiments, the body 82 of the connector 80 includes protrusions 86 that define bays 87. Wire is wrapped around a central core 88, which extends along the longitudinal body axis 84, at each bay 87 forming the wire loops 92 of the conductive coils 90. The wire loops 92 encircle the longitudinal body axis 84 and each wire loop 92 has a first bight 92*a* and a second bight 92*b* as shown. As described herein, a bight is a bend or curve in a wire. In this illustrative embodiment, the wire loops 92 have a substantially "racetrack" shape; however, other embodiments of electrical connectors include wire loops 92 with other shapes are described below with respect to FIGS. 3A to 3C, as the present invention is not limited in this regard. It should be noted that although wire loop 92 appears to be a continuous ring, dotted line 96 in the drawings schematically indicates that the wire moves out of the cross-sectional plane at some point to form the next wire loop 92 along the axis 84.

FIGS. 2A to 2C also schematically depict a first mating element 102 with a surface 102*s* and a second mating element 104 with a surface 104*s*. The first mating element 102 engages the connector 80 by moving toward the connector 80 and the second mating element 104 along and engagement axis 105. An engagement force that moves the first mating element 102 is depicted by arrow 106.

In some embodiments the engagement axis 105 is perpendicular to one or both of the first mating surface 102*s* and the second mating surface 102*s*, and in other embodiments the engagement axis 105 is not perpendicular to first mating surface 102*s* or the second mating surface 104*s*. In one embodiment, the engagement axis 105 is perpendicular to the first mating element surface 102*s* and the second mating element surface 104*s*, as depicted.

Relevant height measurements of the connector 80 are described relative to the engagement axis 105. The height of the body 82 including protrusions 86 is labeled $h_P$. The height of the wire loops 92 is labeled $h_L$. A separation distance $h_S$ between the first mating element surface 102*s* and the second mating element surface 104*s* is also measured along the engagement axis 105.

FIG. 2A depicts the multi-contact electrical connector 80 just as the loop 92 first touches both the first mating element 102 and the second mating element 104. The first mating element 102 contacts the loop 92 at the first bight 92*a* and the second mating element 104 contacts the loop 92 at the second bight 92*b* as shown. At first contact, a separation $h_S$ between the first mating element 102 and the second mating element 104 is equal to the undeformed wire loop height $h_L$.

In FIG. 2B, the first mating element 102 has been moved toward the second mating element 104 to engage the electrical connector 80 as indicated by arrow 106. The separation $h_S$ between the first mating element 102 and the second mating element 104 has been reduced to less than the undeformed wire loop height $h_L$ (see FIG. 2A). This reduction in the separation $h_S$ between the first mating element 102 and the second mating element 104 causes the wire loop 92 to elastically deform. During deformation of the wire loop 92 the first bight 92*a* of the wire loop and the second bight 92*b* of the wire loop move toward a center 93 of the wire loop 92 as indicated by arrows 94, and sides 92*c* and 92*d* of the loop 92 deform away from the center 93 of wire loop as indicated by arrows 95. The elastic deformation of the loop 92 provides a first contact normal force $F_{N1}$ on the first mating element 102 at the first bight 92*a* of the loop and provides a second contact normal force $F_{N2}$ on the second mating element 104 at the second bight 92*b* of the loop. The first contact normal force $F_{N1}$ and the second contact normal force $F_{N2}$ are substantially parallel to the engagement axis 105.

In FIG. 2C the separation $h_{SF}$ between the first mating element 102 and the second mating element 104 has been reduced to the height of the body with protrusions $h_P$ (see FIG. 2A). The reduction in the separation causes greater deformation of the wire loop 92 as indicated by arrows 94 and 95, which increases the first contact normal force $F_{N1}$ and the second contact normal force $F_{N2}$. The minimum separation between the first mating element 102 and the second mating element 104 is equal to the body height with protrusions $h_P$ (see FIG. 2A). A separation smaller than $h_P$ is prevented by physical contact between the first mating element 102 and the body protrusions 86 and physical contact between the second mating element 104 and the body protrusions 86. Thus, the height of body with protrusions can set a minimum separation distance $h_{SM}$ between the first mating element 102 and the second mating element 104. When the separation $h_S$ between the first mating element 102 and the second mating element 104 is less that the loop height $h_L$, as depicted in FIGS. 2B and 2B, then the wire loops 92 provide elastic contact normal forces $F_{N1}$ and $F_{N2}$. The minimum separation distance $h_{SM}$ between the first mating element 102 and the second mating element 104 may be referred to as the "activated height" of the connector.

In some embodiments, a width of the body with protrusions $w_P$ can determine how much room the wire loop 92 has to deform laterally in the directions indicated by arrows 95. Although the multi-contact electrical connector 80 is depicted without any lateral support elements for the sake of clarity, generally, the connector 80 will be laterally supported by elements which may physically limit the lateral deformation of the wire loop 92. Because the width of the body plus protrusions $w_P$ sets the spacing between the connector 80 and other elements, the width of the body plus protrusions determines the space that the wire loop has to deform in the directions indicated by arrows 95. For many embodiments, the body including protrusions should be sufficiently wide that at minimal separation distance ($h_{SM}=h_P$), the deformed wire loop 92 is not touching both lateral support elements.

The size of the contact normal forces $F_{N1}$ and $F_{N2}$ and the functional relationship between the contact normal forces $F_{N1}$ and $F_{N2}$ and conductor separation $h_S$ depends on many factors including, but not limited to, the cross-sectional diameter of the wire loop 92, the shape of the wire loop 92, the materials properties of the wire loop 92, etc. Other techniques can be used to change the contact force, as aspects of the invention are not limited to those discussed above.

The wire loop 92 must be made of a material that is sufficiently conductive and sufficiently stiff to provide acceptable contact normal forces. Embodiments may include wire made of a suitable conductive material, such as, but not limited to: copper, platinum, lead, tin, aluminum, silver, carbon, gold, or any combination or alloy thereof, and the like. In one embodiment, the wire is made of a copper alloy. Generally, for copper alloys, the higher the percentage of copper the greater the conductivity of the alloy. Unfortunately, generally the higher the percentage of copper the lower the stiffness of the alloy. In choosing a material for the wire loop 92 the need for high conductivity must be balanced against the need for sufficient contact force. In one embodiment, a contact force of about 1.5 grams per contact, in this example per wire loop, is provided, though other suitable contact forces may be provided, as the present invention is not limited in this respect. In one embodiment, a contact force of about 20 grams per contact is provided. One embodiment includes wire made of a spring tempered beryllium-copper alloy that has a conductivity about half that of pure copper and an elastic modulus of about 110,000 pounds per square inch (psi).

In some embodiments, the minimum separation distance $h_{SM}$ between the first mating element 102 and the second mating element, which is the activated height, can be controlled through the height and width of the body 82, the height of the wire loops 92 and the shape of the wire loops 92.

A longitudinal axis 96 of an elongate wire loop 92 may be perpendicular to the first contact surface 102*s* and/or the second contact surface 104*s*, or the longitudinal loop axis 92 may be non-perpendicular with respect to the first contact surface 102*s* and/or the second contact surface 104*s*. In the embodiment depicted in FIG. 2C, the wire loop 92 is elongate with a loop axis 96 that forms an acute angle $\alpha_L$ with respect to the first contact surface 102*s*. Although the loop angle $\alpha_L$ is about 65° in the illustrative embodiment shown, other embodiments include wire loops 92 with different loop angles, as the invention is not limited in this regard.

In some embodiments, force 106 exerted on the loop may cause the loop 92 to slip and rotate relative to the first contact surface 102*s* or the second contact surface 104*s*. In FIG. 2C, the loop 92 has rotated relative to the first contact surface 102 and relative to the body 82 causing the first bight of the loop 92 to slide or "wipe" across the first contact surface 102 as indicated by arrow 99. As described in the background, "wiping" may help remove debris that might be on the first bight 92*a* of the loop or on the first mating element surface 102*s*, which might otherwise reduce the reliability of the connection. Wiping action may also help break oxide layers that can limit conductivity.

Figure 3A:
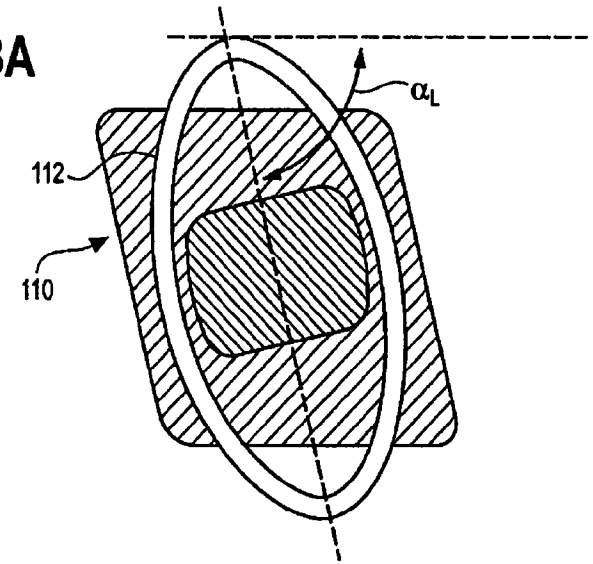
FIGS. 3A-3D schematically depict alternative embodiments of a cross-section of a connector, in accordance with different embodiments of the invention.
Figure 3B:
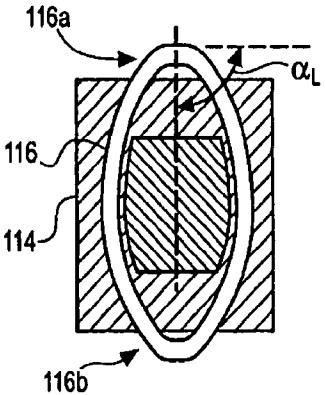
Figure 3C:
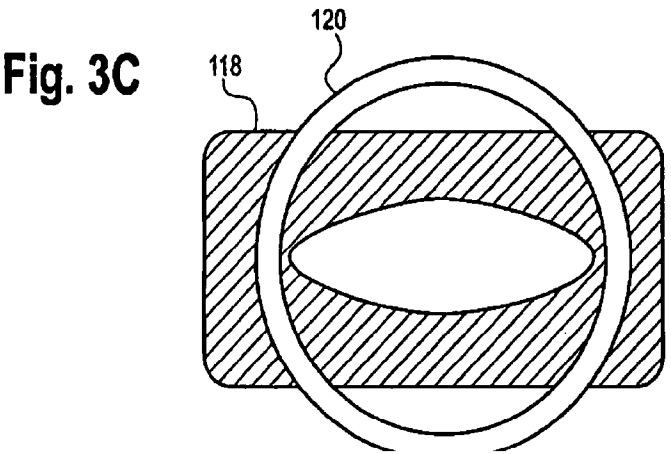

FIGS. 3A to 3D schematically depict cross-sections of embodiments of a multi-contact electrical connector with different wire loop shapes and with different loop angles. FIG. 3A schematically depicts an embodiment of a connector 110 with a substantially oval shaped wire loop 112 and a loop angle $\alpha_L$ that is not about 90 degrees. FIG. 3B schematically depicts an embodiment of a connector 114 with a wire loop 116 that is substantially oval shaped and flattened at a first bight 116*a* and a second bight 116*b*. Unlike the embodiments depicted in FIGS. 1A to 2B and FIG. 3A, wire loop 116 has a loop angle $\alpha_L$ that is about 90 degrees Another embodiment of a multi-contact electrical connector 118 includes a wire loop 120 with a circular shape that has no longitudinal loop axis.

Figure 3D:
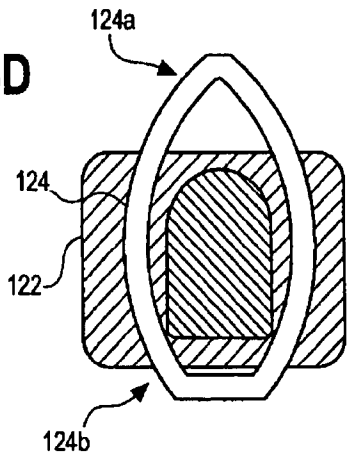

Although embodiments of an electrical connector depicted in FIGS. 1A to 3B above include a wire loop with a first bight that has a same shape as a second bight, other embodiments of an electrical connector include a wire loop having a first bight with a different shape than a second bight, as schematically depicted in FIG. 3D. An electrical connector 122 includes a wire loop 124 with a pointed first bight 124*a* and with a flattened second bight 124*b*. The wire loops may have different shapes and different orientations, as the invention is not limited in this regard.

Figure 4A:
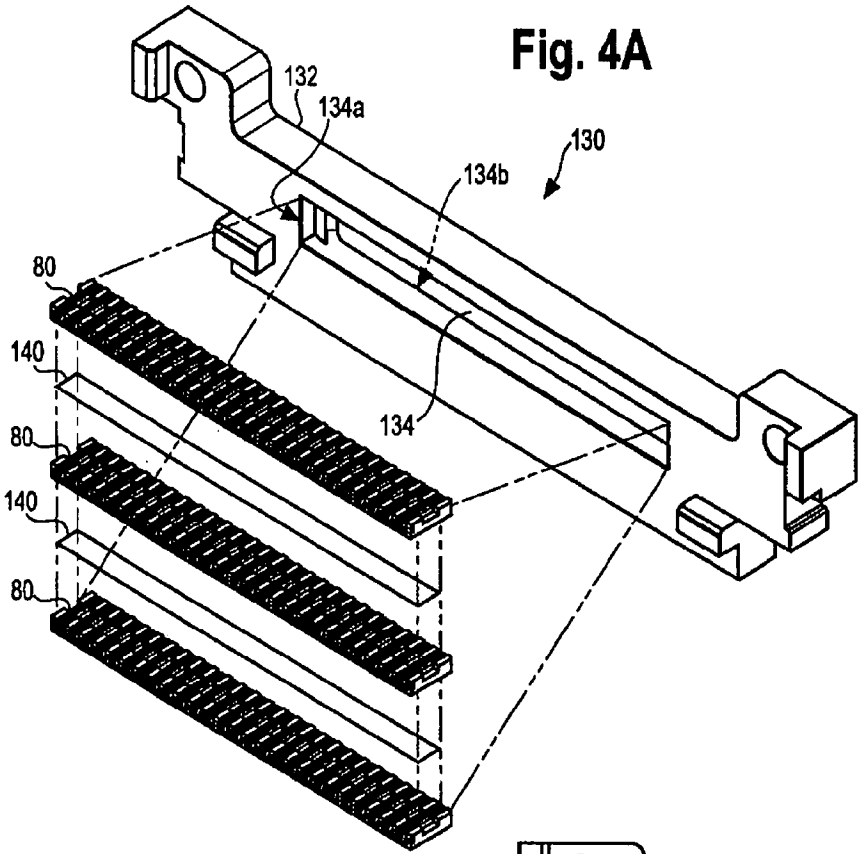
FIG. 4A depicts an exploded perspective view of an another embodiment of a multi-contact electrical connector including connector elements disposed in a housing.
Figure 4B:
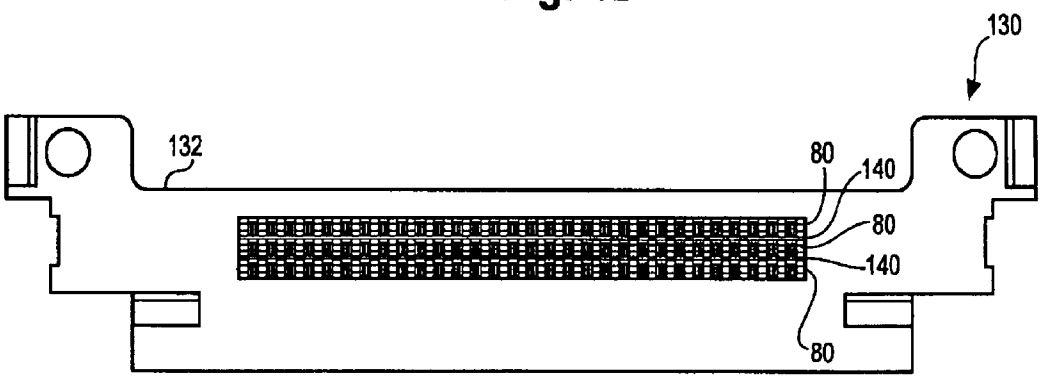
FIG. 4B depicts a front view of the electrical connector shown in FIG. 4A.

FIGS. 4A and 4B, depict a different embodiment of a multi-contact electrical connector 130 with a housing 132 and at least one connector element 80. In some embodiments the connector element may be in the form of the connector 80, described in FIGS. 1A to 2C. The housing 132 includes a receptacle 134 with a first opening 134*a* and a second opening 134*b*, as shown in the exploded perspective view of FIG. 4A. The at least one connector element 80 is disposed in the receptacle of the housing. In some embodiments the connector 130 has a plurality of connector elements 80 disposed in the housing and the connector elements 80 may be separated by insulating separators 140. The connector elements 80 and the insulating separators 140 are disposed in the receptacle 134 as depicted in the front view of FIG. 4B.

Figure 4C:
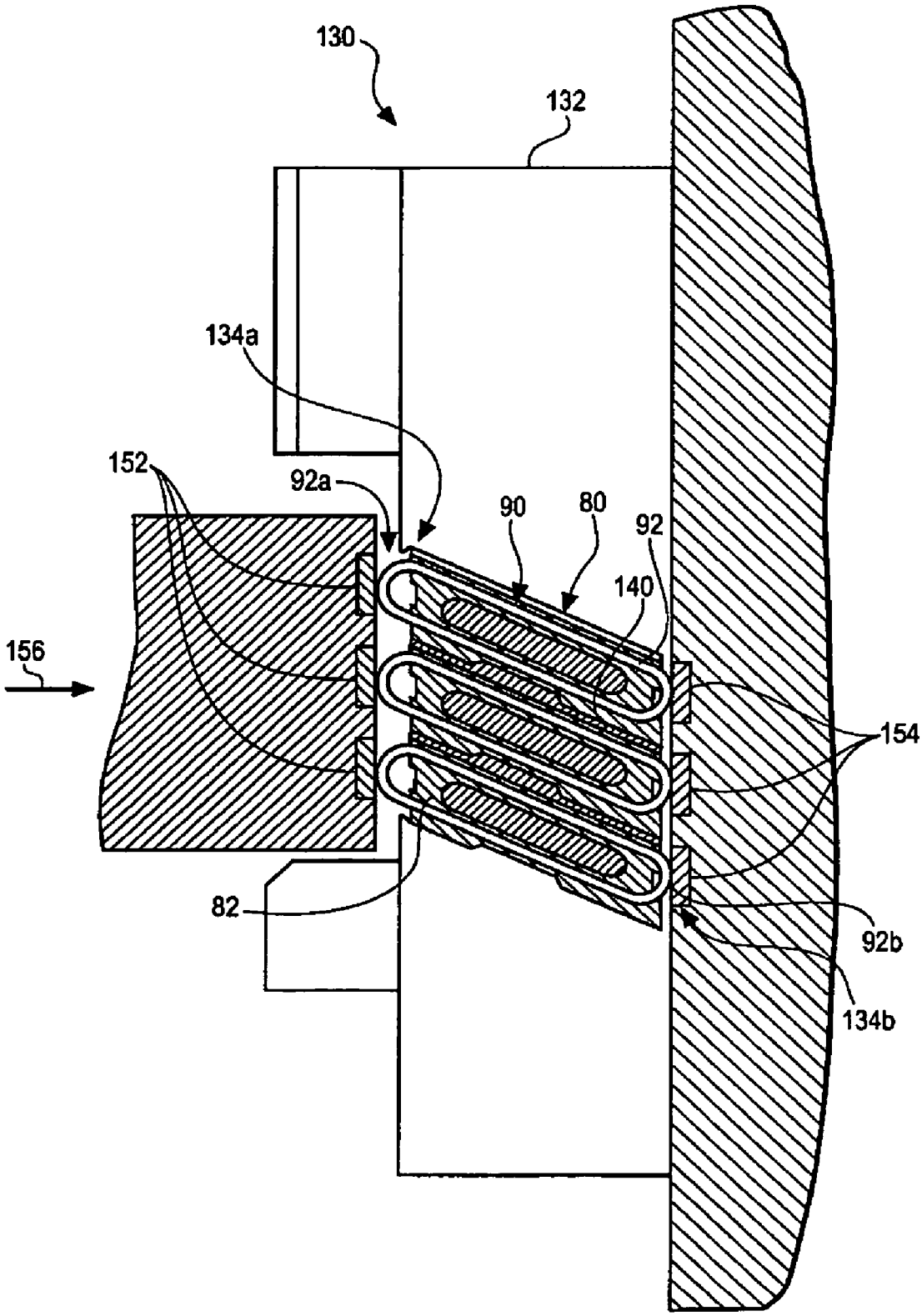
FIG. 4C is a schematic representation of a side cross-sectional view of the electrical connector shown in FIGS. 4A and 4B engaging a first set of mating elements and a second set of mating elements.

FIG. 4C schematically depicts a side cross-sectional view of the multi-contact electrical connector 130 illustrating contact with a set of first mating elements 152 and a set of second mating elements 154. Each connector element 80 includes a body 82 and a plurality of conducting coils 92 each having at least one loop 90 with a first bight 92*a* and a second bight 92*b*. The housing 132, the body 82 of each connector element 80 and are adapted to position the wire loops 92 of the conductive coils 90 such that the first bight 92*a* of each wire loop 92 extends through the first opening 134*a* of the housing receptacle to contact the first set of mating elements 152 and such that the second bight 92*b* of each wire loop extends through the second opening 134*b* of the housing receptacle to contact the second set of mating elements 154. In FIG. 4C, the first set of mating elements 152 has just come in contact with the wire loops 92. To engage the connector 130 the first set of mating elements 152 must be moved in the direction indicated by arrow 156.

In the embodiment depicted in FIGS. 4A through 4C each connector element 80 is electrically isolated from the others 80, and the conducting coil 90 in each bay 87 is isolated from other conducting coils 90. However, in other embodiments, multiple connector elements 80 and/or multiple conducting coils 90 may be in electrical contact with each other, as the present invention is not limited in this respect.

In the embodiment depicted in FIGS. 4A through 4C the connector elements 80 are arranged side-by-side in a stack. However, in other embodiments the multi-contact electrical connectors 80 may be arranged end-to-end or both end-to-end and side-by-side as the present invention is not limited in this regard.

Figure 5A:
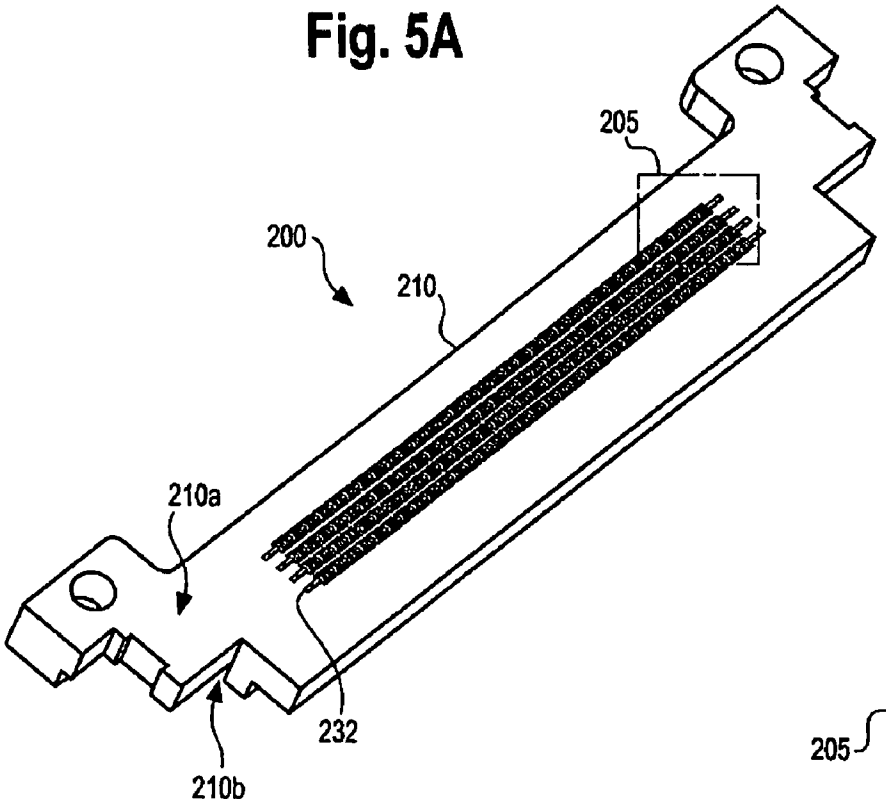
FIG. 5A schematically depicts a perspective view of a multi-contact electrical connector with connective coils disposed in channels of a body, in accordance with another embodiment of the invention.
Figure 5B:
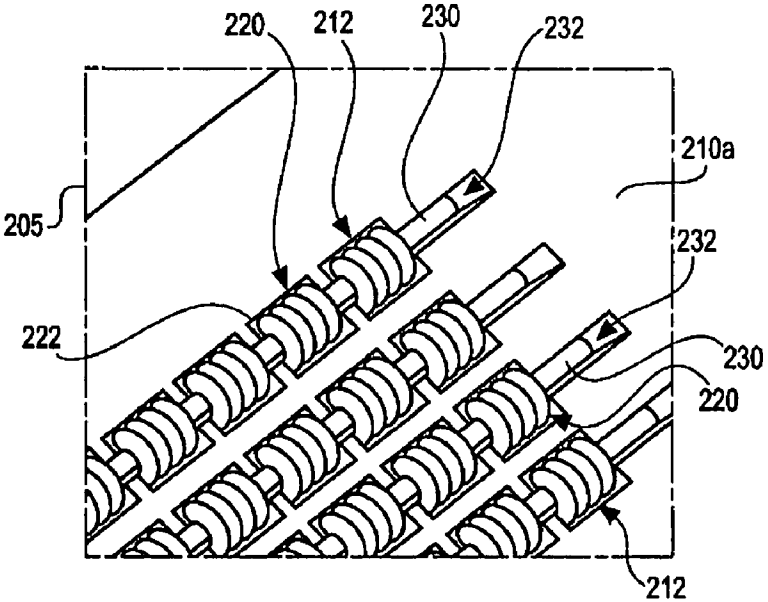
FIG. 5B schematically depicts a detail of FIG. 5A.

A multi-contact electrical connector may include channels in which conductive coils are disposed, according to an embodiment of the invention. FIG. 5A schematically depicts a perspective view of a multi-contact electrical connector 200 and FIG. 5B schematically depicts a detail view of the connector 200 shown FIG. 6A. The connector 200 has a plurality of conductive coils 220 each formed of one or more wire loops 222. Each wire loop 222 is adapted to elastically deform. The connector 200 also includes a body 210 having a first side 210*a* a second side 210*b*, and a plurality of channels extending from the first side 210*a* to the second side 21*b* of the body. Each channel 222 is configured to position at least one conductive coil 222 disposed in the channel. A first bight of each loop of each coil 222*a* may extend beyond a first side of the body 210*a* and a second bight of each loop (210*b*) may extend beyond a second side of the body 210*b* (see also FIGS. 5C and 5D). When the electrical connector is engaged with a mating element, physical contact between the one or more wire loops 222 and the mating element deforms the wire loops 222 providing an elastic normal contact force.

The connector 200 may also include at least one retaining element 230 to prevent the conductive coils 220 from completely exiting the body 210 through the channels 220. In some embodiments, the first side 210*a* of the body has one or more slots 232 that intersect the one or more channels 220 in which the coils 220 are disposed. The one or more slots 232 are sized and configured to receive the at least one retaining element 230.

Figure 5D:
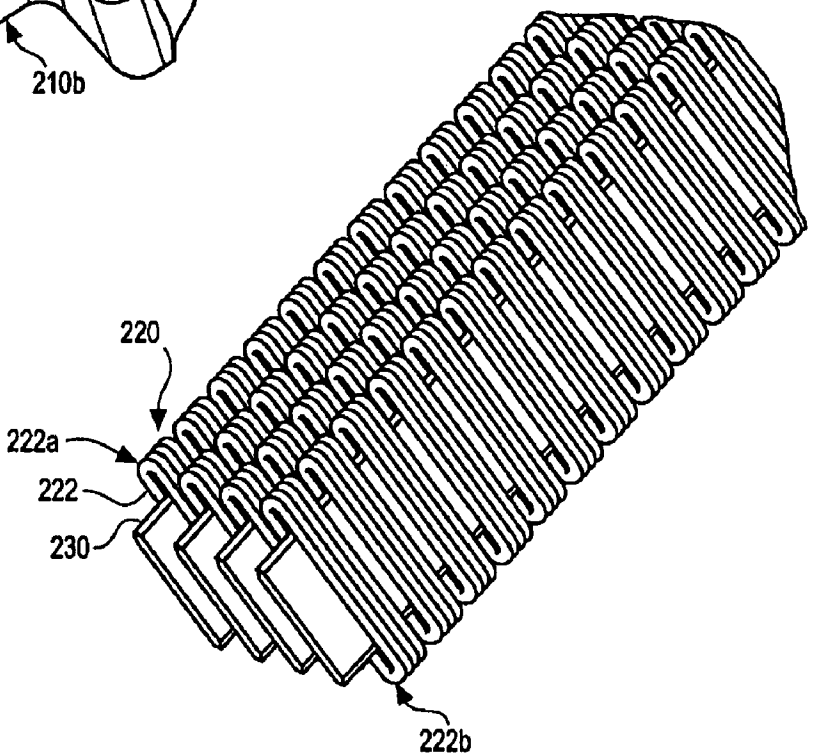
FIG. 5D schematically depicts conductive coils and retaining elements of the connector shown in FIGS. 5A and 5B.
Figure 5C:
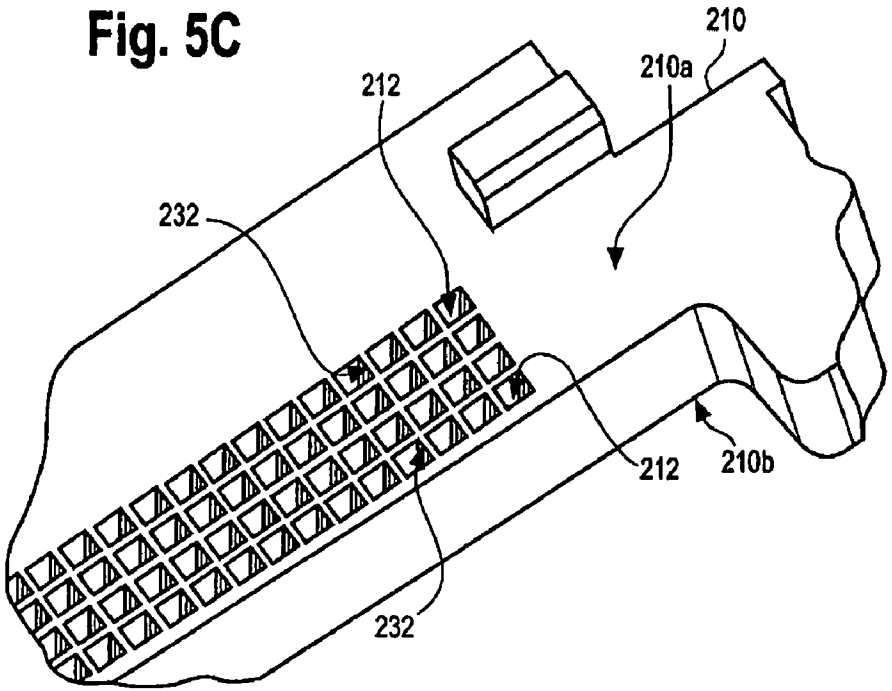
FIG. 5C schematically depicts a perspective view of a portion of an opposite side of the body of the connector shown in FIGS. 5A and 5B.

FIG. 5C depicts a perspective view of a portion of the second side 210*b* of the body 210 of the connector 200 and FIG. 5D depicts a perspective view of conductive coils 220 and retaining elements 230 of the connector 200. In some embodiments, when the conductor 210 is assembled, the coils may be positioned on the retaining elements 230 with a spacing of the coils 220 on the retaining elements 230 corresponding to a spacing of the channels 212 along the slots 232 as depicted in FIG. 5D. Then, the retaining elements 230 and coils 220 may be placed into the body 210 together through the slots on the first side 210*a* of the body.

In another embodiment, the body has retaining channels that intersect the positioning channels 212. During assembly, the coils 220 may be placed in the channels 121, then the retaining elements 230 may be inserted into the retaining channels of the body and threaded through the loops 222 of the coils 220 disposed in the positioning channels 212. In another embodiment, the retaining elements are protrusions in the channels 212 that prevent the coils 220 from exiting the channels, as the invention is not limited in this regard.

Figure 6:
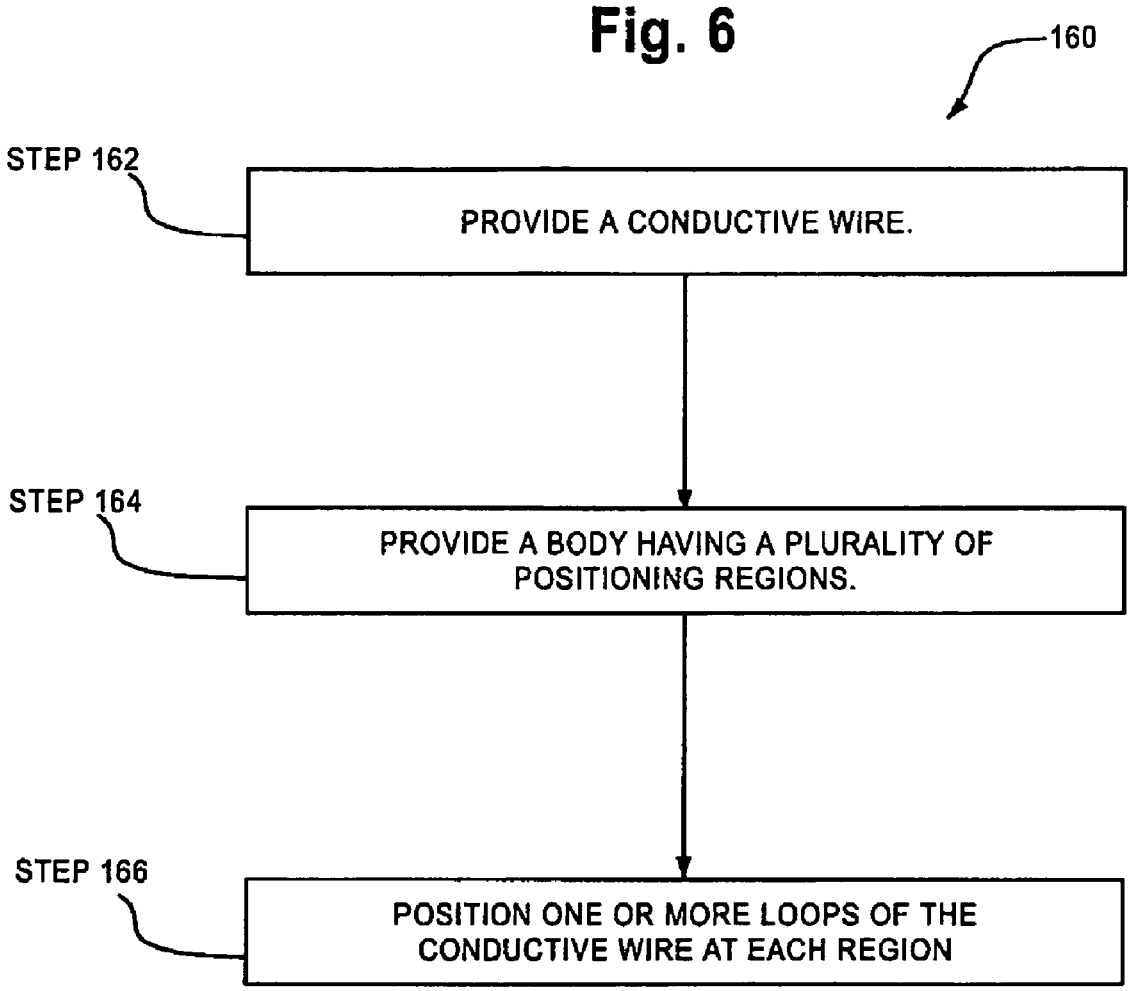
FIG. 6 is a flow chart of a method of making a multi-contact electrical connector, in accordance with an embodiment of the invention.
Figure 7C:
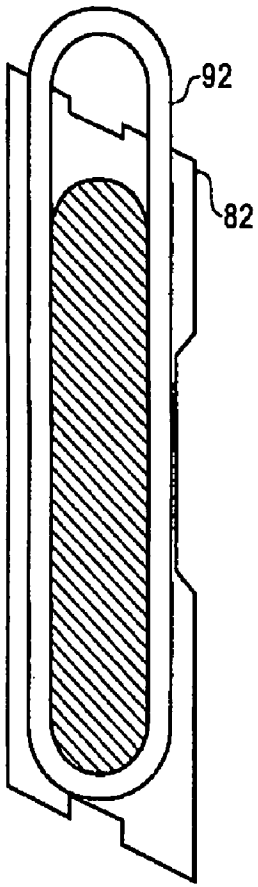
FIG. 7C schematically depicts a side cross-sectional view of a connector after the spacer element is removed as described in the method of FIG. 6.
Figure 7B:
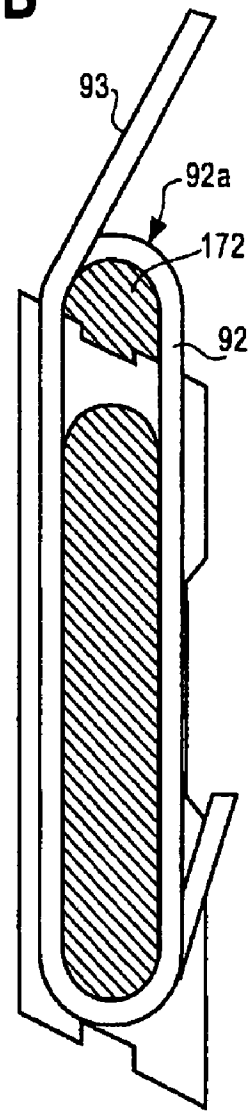
FIG. 7B schematically depicts a side cross-sectional view of the body and spacer element being wrapped with a conductive wire as described in the method of FIG. 6.
Figure 7A:
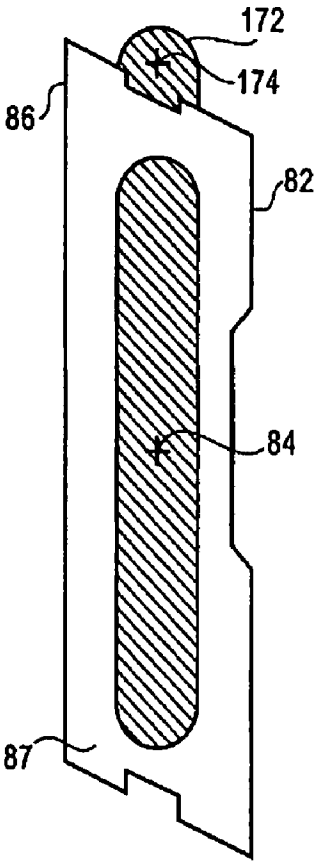
FIG. 7A schematically depicts a side cross-sectional view of a body and a spacer element described in the method of FIG. 6.

Another exemplary embodiment is a method of making a multi-contact electrical connector, which is depicted the flow chart of FIG. 6 and illustrated in FIGS. 7A to 7C. Solely for illustrative purposes, the method 160 will be described primarily with respect to reference numbers for the multi-contact electrical connector 80 depicted in FIGS. 1A to 2C, and in FIGS. 7A to 7C. Initially a conductive wire 93 is provided (step 162). A body 82 having a plurality of positioning regions is provided (164). In the embodiment depicted in FIGS. 1A to 2C, the bays 87 of the body 82 are positioning regions. In one embodiment, the method includes positioning a spacer element 172 with a longitudinal spacer element axis 174 along a side of the body 82 such that the longitudinal spacer element axis 174 is substantially parallel to the longitudinal body axis 84, as depicted in FIG. 7A. One or more loops 92 of the conductive wire are positioned at each region, forming a coil having one or more loops 92 of conductive wire 93 at each region (step 164).

In one embodiment, positioning the one or more loops 92 of the conductive wire 93 at each region (step 166) includes wrapping the wire 93 around the body 80 at each region to form the one or more wire loops 92. The wire 93 may be wrapped to encircle both the body 80 and the spacer element 172 as depicted in FIG. 7B. The conductive wire 93 may be wrapped around the body 82 once or a plurality of times as desired. In the embodiment shown in FIGS. 1A to 2C, the conductive wire 93 is wrapped around the body four times at each bay 87. A cross-sectional shape of the spacer element 172 along the longitudinal spacer element axis 174 can affect a shape of the wire loop 92 formed, especially a shape of the first bight 92*a* of the wire loop 92.

After the wire loops 92 are formed at each bay 87, the conductive wire 93 may be cut between each bay forming a discrete conductive coil 90 at each bay. In other embodiments, the conductive wire 93 wire may be cut between only some of the bays 97. In yet another embodiment, the conductive wire 93 may be uncut forming one continuous conductor on the connector. In some embodiments, the method also includes removing spacer element 172 producing a multi-contact electrical connector 80, as depicted in FIG. 7C.

In another embodiment, the method 160 may be described with respect to the connector 200 appearing in FIGS. 5A to 5D. In one embodiment, the channels 212 of the body 210 are positioning regions The method may include forming each coil 220 having one or more loops 222 of conductive wire before positioning the one or more loops 222 of the conductive wire at each region of the body 212. In one embodiment the body 210 may include one or more slots 232 formed in a first side of the body 210*a* with each slot 232 intersecting one or more channels 212. Positioning the one or more loops 222 of the conductive wire at each positioning region 212 (step 166) may include providing one or more retaining elements 230 and positioning each coil 220 on one of the one or more retaining elements 230 such that a spacing of the coils 220 on the retaining element 232 corresponds to a spacing of the channels 212 with respect to the slot 232 that intersects the channels 212. The positioning may also include inserting the one or more retaining elements 230 together with the coils 220 into the body 210 through the one or more slots 232.

In another embodiment, the body 210 may have retaining channels that intersect one or more positioning channels 212 of the body. Positioning the one or more loops 222 of the conductive wire at each positioning region 212 (step 166) may include placing each coil 220 in a channel 212 of the body 210 through the first side 210*a* of the body, and inserting a retaining element 230 into each retaining element channel of the body, wherein the retaining element 210 is encircled by each coil 220 disposed in each channel 212 through which the retaining element 230 extends.

As described herein, the term loop includes a closed loop that is a ring, and the term conductive coil includes both a continuous wire wrapped in loops or a stack of rings that are electrically coupled.

It is to be appreciated that embodiments of the present invention can be adapted for use in a wide variety of applications. Some of the more prevalent applications include power and/or data transmission. A housing may include multiple arrays of connectors, in a row or in a grid, each used to transmit power or data, or combinations of arrays used for either purpose. Additionally, conductive coils within a given array may be connected to a common source conductor, or may be connected to individual source conductors that are used for similar or different purposes. It is to be appreciated that variations, such as those mentioned above, and others, can be made without departing from aspects of the invention.

Embodiments of the invention may be produced using any technique or component (or any suitable combination thereof) described in any of U.S. Pat. Nos. 6,942,496; 7,101,194; 7,021,957; 7,083,427; 6,945,790; 7,077,662; 7,097,495; 7,125,281; 7,094,064; 7,214,106 and 7,056,139—each of which is presently assigned to the assignee of the present application and each of which is hereby incorporated by reference in its entirety.

One illustrative example will now be described, which in no way should be construed as further limiting.

EXAMPLE

A prototype connector was built of a multi-contact electrical connector and the resistance of the connector was tested. As described above, both the passage of time and thermal cycling may increase resistance in a connector. The resistance of a conductor may also be a function of the temperature of the connector. Accordingly, voltage drops across different portions of the connector were measured to determine an initial resistance of different portions of the connector. Then measurements of voltage drop across all of the connector were taken at different temperatures after various numbers of thermal cycles had been completed to show the resistance across the connector as a function of temperature and number of thermal cycles.

The prototype connector included two connector elements, each with 10 bays and 4 loops of wire that formed a coil in each bay. The bays were spaced such that 0.05 inches separated a point on a first bay and a corresponding point on an adjacent bay (i.e. a pitch or a center-to-center distance). Each wire was made from 0.007 inch diameter spring tempered wire of a beryllium copper alloy "C17500" with an elastic modulus of 110,000 psi, and that has a conductivity that is about half the conductivity of pure copper wire.

Procedure:

The prototype connector was mated between two 10×2 land grid array (LGA) boards with square conductive pads for testing. A pitch between the pads (center of pad to center of pad separation distance) was 0.05 inches. The coil at each bay of the connector electrically connected a pad of the first LGA and a corresponding pad of the second LGA (a pair of pads). During the tests, 1 Ampere (A) of current passed through the connector, meaning that the connector was subject to a 1 A current load. All of the pairs of pads were serially connected (daisy chained) and the current was applied to the ends of the "daisy chain" to ensure that the same current flowed through each pair of pads. Kelvin taps, which exhibit very high input impedance, were used when measuring voltages. A voltage drop from a pad of the first LGA to a corresponding pad of the second LGA was measured at room temperature for 18 different pairs of pads, that correspond to 18 different positions (18 different conductive coils), of the connector. Next, measurements of the average resistance across all of the pairs of pads and corresponding conductive coils connected serially under a 1 A current load were made at various temperatures during thermal cycling between −25° C. and 100° C. For each thermal cycle, the connector temperature was raised from −25° C. to 100° C. over a 1 hour ramp time, then the connector temperature was held at 100° C. for a 1 hour soak time. Measurements presented here include up to the 21st thermal cycle.

Figure 8A:
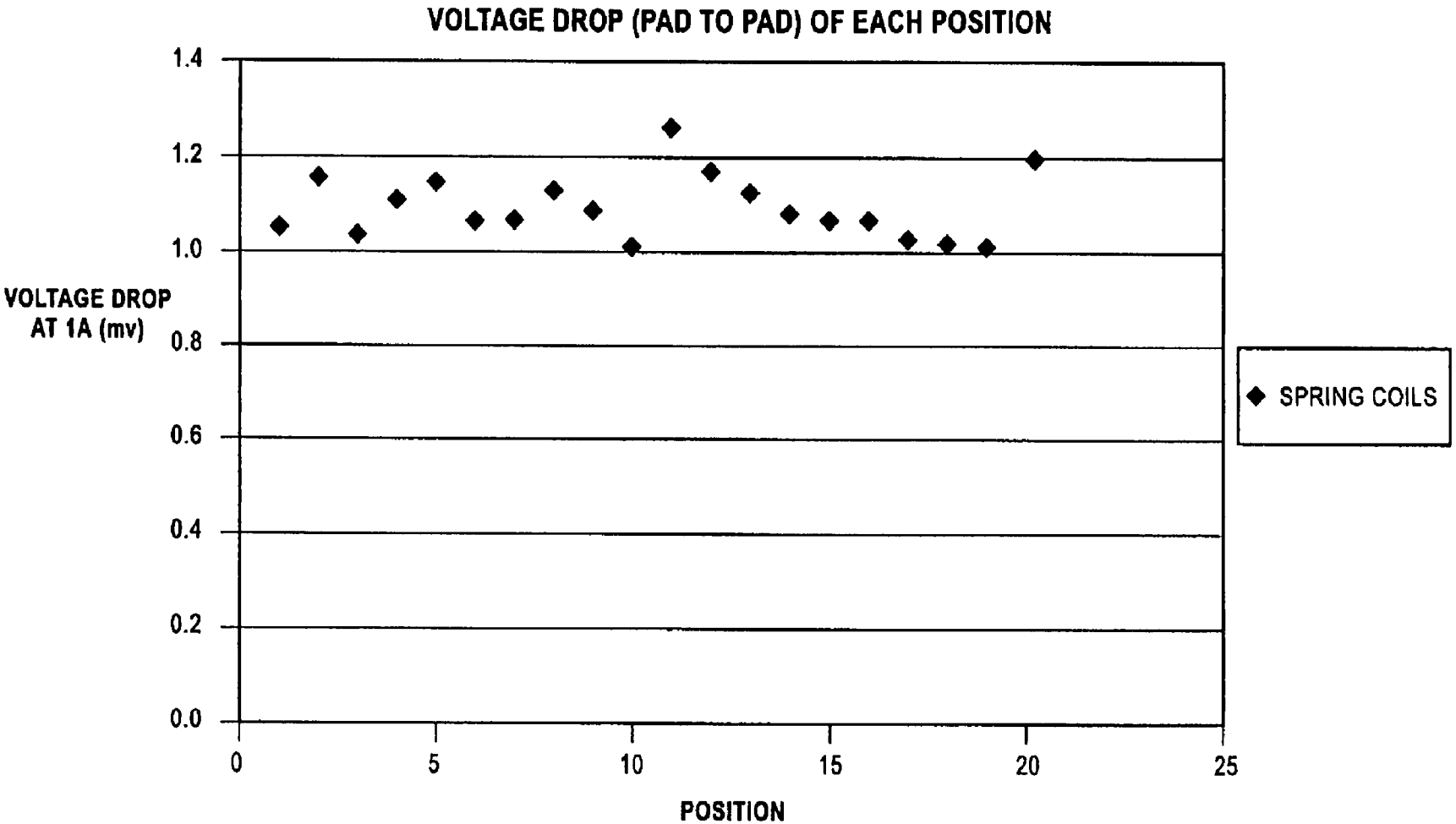
FIG. 8A is a graph of a measured voltage drop across a portion of a prototype connector that connects a conducting pad of a first mating element and a conductive pad of a second mating element (pad to pad voltage drop) vs. location, measured across different sets of pads at different locations for a 1 Ampere (A) current load.

Results:

FIG. 8A is a graph of measurements of a pad to pad voltage drop across the connector at 18 different positions on the connector. As indicated by the table, the initial voltage drop at all positions along the connector was between about 1.0 milliVolts (mV) and about 1.3 mV indicating that each conductive coil had about the same resistance.

Figure 8B:
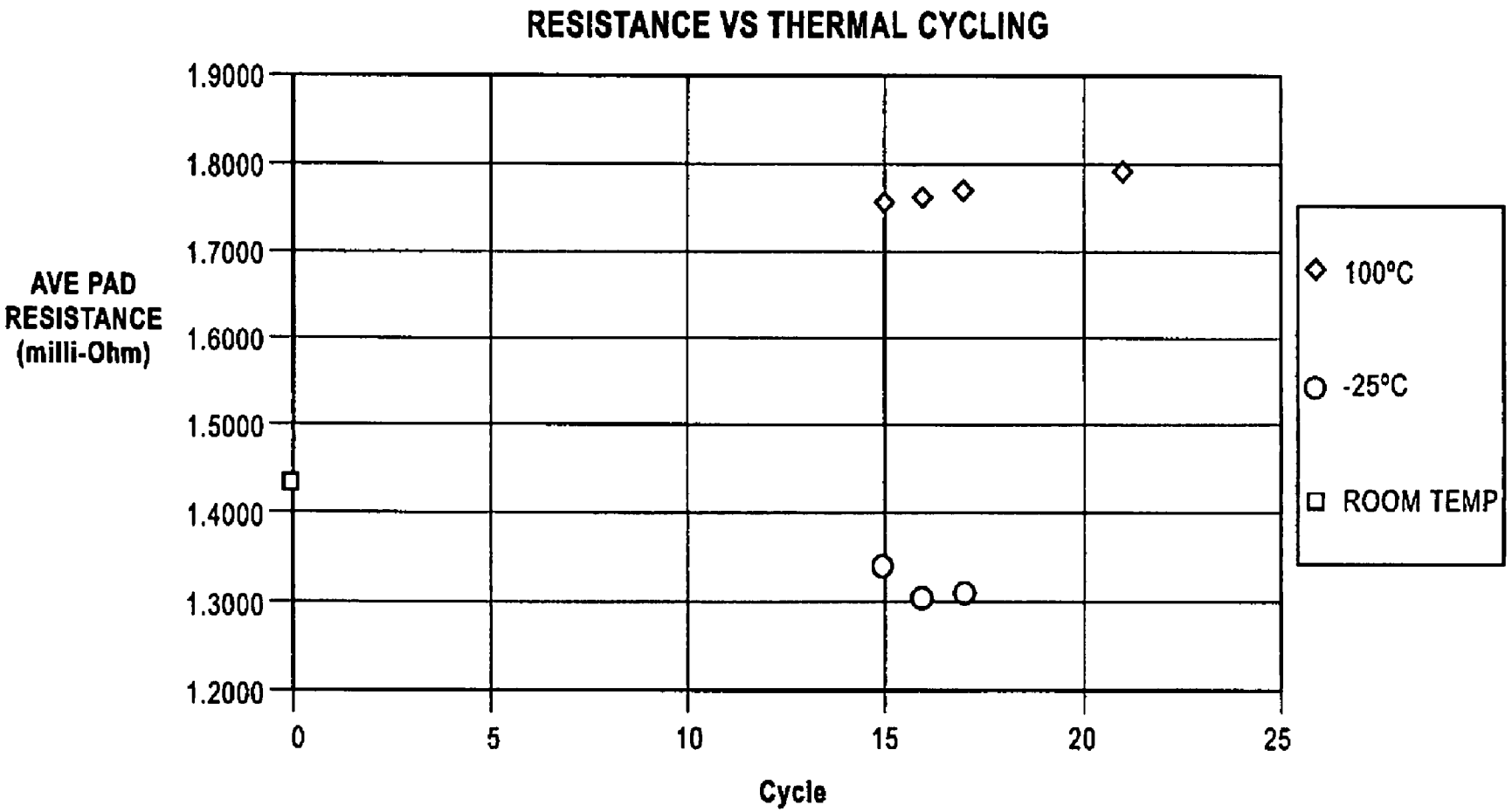
FIG. 8B is a graph of an average pad resistance verses cycle for the prototype connector during various cycles while it was repeatedly thermally cycled between −25° C. and 100° C.

Table 1 below shows an average pad to pad voltage drops and resistances across the entire connector measured at −25° C. and 100° C. taken during various thermal cycles. FIG. 8B presents the resistance data of Table 1 in a graph of average pad to pad resistance versus number of thermal cycles. The initial voltage drop of 0.0258 mV was measured at room temperature yielding an initial resistance of 1.433 milliOhms (mOhm or mΩ). For the $15^{th}$, $16^{th}$ and $17^{th}$ thermal cycles, measurements of the voltage drop were made at 100° C. and at −25° C. For the $21^{st}$ thermal cycle, measurements of the voltage drop were made at 100° C.

The resistance of the connector at 100° C. was between 1.755 mOhm and 1.788 mOhm for thermal cycles 15, 16 and 21. The resistance of the connector at −25° C. measured between 1.333 mOhm and 1.305 mOhm for thermal cycles 15, 16 and 17.

TABLE 1

| | Room Temperature | | 100° C. | | −25° C. | |
|---|---|---|---|---|---|---|
| Cycle | V. Drop (mV) | Resistance (mΩ) | V. Drop (mV) | Av. Pad Res. (mΩ) | V. Drop (mV) | Av. Pad Res. (mΩ) |
| 0 | 0.0258 | 1.43 | | | | |
| 15 | | | 0.0316 | 1.755 | 0.024 | 1.333 |
| 16 | | | 0.0317 | 1.761 | 0.0235 | 1.305 |
| 17 | | | 0.0318 | 1.766 | 0.0236 | 1.311 |
| 21 | | | 0.0322 | 1.788 | | |

The measured resistances per pad for the prototype connector were very low, less than 1.788 mOhms for all temperatures and all numbers of thermal cycles up to cycle 21. For comparison, some known connectors for use with elements having the same pad pitch (0.50 inches) show about 16 mOhm resistance per pad at the end of life. The average pad resistance measured at −25° C. seemed to be unaffected by thermal cycling and the average pad resistance measured at 100° C. did not seem to be greatly affected by thermal cycling.

It should be appreciated that although the above-illustrated embodiments include combinations of the various described features, the present invention is not limited in this regard as any feature(s) described herein may be employed in any suitable combination.

Having thus described certain embodiments of an electrical connector, various alterations, modifications and improvements will readily occur to those skilled in the art. Such alterations, modifications, and improvements are intended to be within the spirit and scope of the invention. Accordingly, the foregoing description is by way of example only, and not intended to be limiting.

What is claimed is:

1. A multi-contact electrical connector, the connector comprising:

a plurality of conductive coils that each comprise one or more loops of conductive wire, each loop having a first bight;

a retaining element extending through interior regions of corresponding ones of the conductive coils; and a body adapted to position the plurality of conductive coils, the body defining a plurality of channels extending from one surface of the body to another surface of the body, each of the channels configured to receive respective ones of the conductive coils, and the body further defining a slot extending from one of the surfaces of the body and intersecting corresponding ones of the channels, the slot configured to receive the retaining element;

wherein each of the plurality of conductive coils is adapted and positioned to elastically deform due to contact between the first bight of each wire loop and a first mating element providing an elastic normal contact force between the first bight of each wire loop and the first mating element when the connector is engaged with the first mating element.

2. The multi-contact electrical connector of claim 1, each wire loop further having a second bight, wherein the plurality of conductive coils are further adapted and positioned to elastically deform due to contact between the second bight of each wire loop and a second mating element, providing an elastic normal contact force when the connector is engaged with the first mating element and in contact with the second mating element.

3. The multi-contact electrical connector of claim 2, wherein the coils are sized and dimensioned to elastically deform when a separation between the first mating element and the second mating element is between about 3.6 mm and about 5.2 mm.

4. The multi-contact electrical connector of claim 2, wherein the coils are sized and dimensioned to produce a contact normal force of at least about 1.5 grams per contact when the first mating element and the second mating element are engaged with the connector.

5. The multi-contact electrical connector of claim 1, wherein each conductive coil comprises 4 loops.

6. The multi-contact electrical connector of claim 1, wherein the body extends along a longitudinal axis and has a plurality of bays.

7. The multi-contact electrical connector of claim 6, wherein the one or more loops of each coil encircle the longitudinal body axis at a bay in the plurality of bays.

8. The multi-contact electrical connector of claim 6, wherein the coil at each bay is electrically isolated from coils at adjacent bays.

9. The multi-contact electrical connector of claim 6, wherein body is insulative.

10. The multi-contact electrical connector of claim 6, wherein the plurality of bays comprises 30 bays.

11. The multi-contact electrical connector of claim 6, wherein each loop extends along a longitudinal loop axis that is substantially perpendicular to the longitudinal body axis.

12. The multi-contact electrical connector of claim 1, wherein the shape of each wire loop is substantially an oval.

13. The multi-contact electrical connector of claim 1, wherein a diameter of the wire is between about 0.05 mm and about 0.08 mm.

14. The multi-contact electrical connector of claim 1, wherein the coils are adapted and positioned to provide a normal contact force of between about 1.5 grams and about 20 grams per wire loop when the connector is engaged by the first mating element.

15. The multi-contact electrical connector of claim 1, wherein the conductive coils each comprise four loops of conductive wire, and wherein a location on a coil in the plurality of coils is separated by about 0.05 inches from a corresponding location on an adjacent coil.

16. A method of manufacturing a multi-contact electrical connector, the method comprising:

providing a conductive wire;

forming from the conductive wire a plurality of conductive coils, each of the conductive coils comprising one or more loops of the conductive wire;

providing a retaining element;

positioning the retaining element through an interior region of corresponding ones of the conductive coils;

providing a body having a plurality of channels extending from a first side of the body to a second side of the body and a slot intersecting corresponding ones of the channels, the slot adapted to receive the retaining element;

positioning the conductive coils in corresponding channels; and positioning the retaining element in the slot.

17. The method of claim 16, wherein positioning one or more loops of the conductive wire at each region comprises wrapping the conductive wire around the body at each region forming each coil positioned at each region.

18. The method of claim 17, further comprising positioning a spacer element along a side of the body, and wherein the conductive wire wrapped around the body at each region encircles both the body and the spacer element.

19. The method of claim 18, further comprising, removing the spacer element.

20. The method of claim 16, further comprising forming each coil having one or more loops of conductive wire before positioning the one or more loops of the conductive wire at each channel of the body.

21. The method of claim 16, wherein the one or more loops comprise 4 loops.

22. The method of claim 16, wherein the plurality of channels comprises 30 channels.

* * * * *